US006913064B2

(12) United States Patent
Beals et al.

(10) Patent No.: US 6,913,064 B2
(45) Date of Patent: Jul. 5, 2005

(54) REFRACTORY METAL CORE

(75) Inventors: James T. Beals, West Hartford, CT (US); Dilip M. Shah, Glastonbury, CT (US); Jacob Snyder, Southington, CT (US); John Wiedemer, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/685,632

(22) Filed: Oct. 15, 2003

(65) Prior Publication Data

US 2005/0098296 A1 May 12, 2005

(51) Int. Cl.[7] ..... B22C 9/10

(52) U.S. Cl. ..... 164/369; 164/6; 164/131; 164/132

(58) Field of Search ..... 164/6, 369, 131, 164/132

(56) References Cited

U.S. PATENT DOCUMENTS

| | | | | |
|---|---|---|---|---|
| 4,096,296 | A * | 6/1978 | Galmiche et al. | 427/247 |
| 4,375,233 | A * | 3/1983 | Rossmann et al. | 164/9 |
| 4,384,607 | A * | 5/1983 | Wood et al. | 164/132 |
| 5,405,242 | A * | 4/1995 | Auxier et al. | 415/115 |
| 5,640,767 | A * | 6/1997 | Jackson et al. | 29/889.721 |
| 6,119,978 | A * | 9/2000 | Kobayashi et al. | 244/35 R |
| 6,190,133 | B1 * | 2/2001 | Ress et al. | 416/229 A |
| 2003/0075300 | A1 | 4/2003 | Shah et al. | |

* cited by examiner

*Primary Examiner*—Kiley S. Stoner
*Assistant Examiner*—I-H. Lin
(74) *Attorney, Agent, or Firm*—Bachman & LaPointe, P.C.

(57) ABSTRACT

A casting system for forming a gas turbine engine component is provided. The casting system, in a first embodiment, comprises a shaped refractory metal sheet having a plurality of features for forming a plurality of film cooling passages, which features are formed from refractory metal material bent out of the sheet. The casting system for forming a gas turbine engine component in a second embodiment comprises a metal wall having an airfoil shape and a refractory metal core adjacent the metal wall and having a shape corresponding to the shape of the metal wall.

17 Claims, 2 Drawing Sheets

REFRACTORY METAL CORE

BACKGROUND OF THE INVENTION

The present invention relates to a refractory metal core for use in a casting system.

Refractory metal cores (RMCs) are metal based casting cores usually composed of molybdenum with a protective coating. The refractory metal provides more ductility than conventional ceramic core materials while the coating (usually ceramic) protects the refractory metal from oxidation during the shell fire step of the investment casting process and prevents dissolution of the core from molten metal. RMCs have shown significant promise in casting feature sizes and geometries not attainable with ceramic cores.

One method of using refractory metal cores is shown in U.S. Published Patent Application No. 2003/0075300, entitled "CORES FOR USE IN PRECISION INVESTMENT CASTING", to Shah et al., which is hereby incorporated by reference herein.

Currently, many gas path component designs are being considered that use a refractory metal core in conjunction with a ceramic core. The ceramic core has many benefits that favor its use in larger sections. Typically, the refractory metal has attached to the ceramic core and have been employed for small feature sizes and complex geometry due to its increased ductility.

Blade outer air seals (BOAS) and low pressure turbine (LPT) blades are two components that may not require large cooled sections but could benefit from either improved cooling or lower cost potential afforded by RMC technology.

SUMMARY OF THE INVENTION

Accordingly, it is an object of the present invention to provide a refractory metal core which may be used in the casting of gas turbine engine components such as BOAS, LPT blades, and turbine airfoils.

The foregoing object is met by the refractory metal core of the present invention.

A casting system for forming a gas turbine engine component is provided. The casting system comprises a shaped refractory metal sheet having a plurality of features for forming a plurality of film cooling passages, which features are formed from refractory metal material bent out of the sheet.

The present invention is also directed to a casting system for forming a gas turbine engine component comprising a metal wall having an airfoil shape and a refractory metal core adjacent the metal wall and having a shape corresponding to the shape of the metal wall.

Still further, the present invention relates to novel refractory metal core configurations. In one embodiment, the refractory metal core comprises a refractory metal balloon or pillow with protrusions or dimples. The refractory metal core has an internal cavity filled with pressurized inert gas, sand, or ceramic powder. In a second embodiment, the refractory metal core comprises a refractory sheet metal hollow core with dimples internally supported by ribs or honeycomb.

Other details of the refractory metal core, as well as other objects and advantages attendant thereto, are set forth in the following detailed description and the accompanying drawings wherein like reference numerals depict like elements.

DETAILED DESCRIPTION OF THE PREFERRED EMBODIMENT(S)

As previously mentioned, a casting system for forming turbine engine components such as BOAS and LPT blades is provided by the present invention. The casting system may be used to provide the gas turbine engine component with cooling features if desired.

Figure 1:
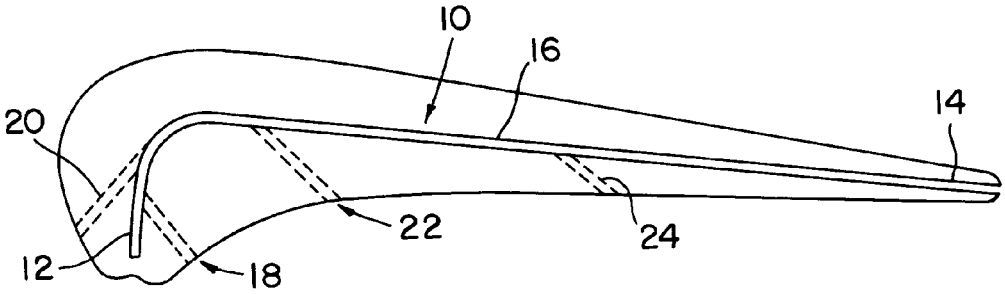
FIG. 1 is a schematic representation of a refractory metal core for forming a turbine engine component having cooling features.

FIG. 1 illustrates a first embodiment of a casting system. In this embodiment, a refractory metal core 10 is used. The core 10 is formed from a metal sheet of refractory metal selected from the group consisting of molybdenum, tantalum, tungsten, niobium, alloys thereof, and mixtures thereof. One material which may be used for the core 10 is a molybdenum-rhenium alloy. Preferably, the refractory core 10 is coated with a ceramic material such as an oxide coating.

The core 10 has a leading edge portion 12, a trailing edge portion 14, and a central portion 16 extending between the leading edge portion 12 and the trailing edge portion 14. The core 10 may have a plurality of bent portions 18 and 20 in the vicinity of the leading edge portion 12. The bent portions 18 and 20 are used to form film cooling passageways. The core 10, if desired, may also have a plurality of bent portions 22 and 24 along the central portion 16 to form still other film cooling passageways. The number of bent portions and the location of the bent portions is a function of the gas turbine engine component being formed and the need for providing film cooling on the surfaces of the component.

If desired, other features may be provided by cutting out portions of the metal sheet forming the core 10.

Figure 2:
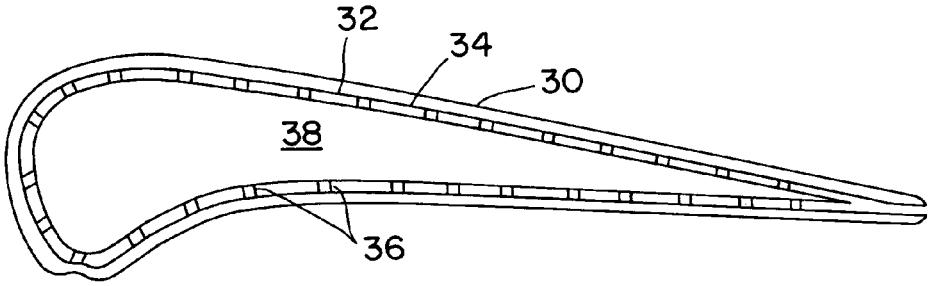
FIG. 2 is a schematic representation of a second embodiment of a refractory metal core for forming a turbine engine component with cooling features.

Referring now to FIG. 2, the casting system includes an outer wall 30 formed from a metal or metal alloy such as a nickel based superalloy. To provide cooling features, a skin core 32 is formed from a sheet of refractory material and is positioned adjacent to an internal surface 34 of the wall 30. The sheet forming the core 32 may be made from any of the refractory materials listed hereinabove. As can be seen from FIG. 2, the skin core 32 has a shape which corresponds to the shape defined by the outer wall 30.

To provide cooling features, the skin core 32 may be provided with a number of cut outs 36 for defining cooling passageways needed to increase convection. If desired, the skin core 32 may have its exterior and/or interior surfaces coated with a ceramic coating.

The casting system may also include a metallic internal component 38 having a shape corresponding to the shape of the wall 30 and the skin core 32. The component 38 may be formed by any suitable metallic material known in the art.

Figure 3:
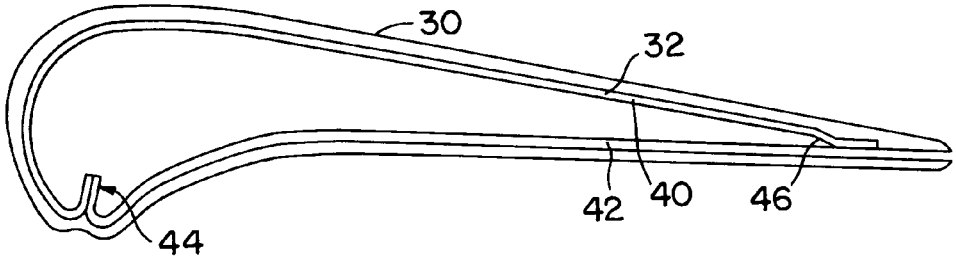
FIG. 3 is a schematic representation of a two piece refractory metal core for forming a turbine engine component.

Referring now to FIG. 3, the casting system includes an outer wall 30 having a shape corresponding to the shape of an airfoil portion of the turbine engine component. As shown in the figure, a refractory metal core 32 having a shape corresponding to the shape of the airfoil portion is provided. The refractory metal core 32 may be formed from any of the materials listed hereinbefore. As can be seen from the figure, the core 32 may be formed by two sheets 40 and 42 of refractory based material joined together at two locations 44 and 46. Any suitable joining technique known in the art, such as welding, bonding, or mechanical joining may be used to join the sheets 40 and 42 together. In the system of FIG. 3, the internal component 38 may be omitted. If desired, each of the sheets 40 and 42 may have its internal and/or exterior surfaces coated with a ceramic coating.

Figure 4:
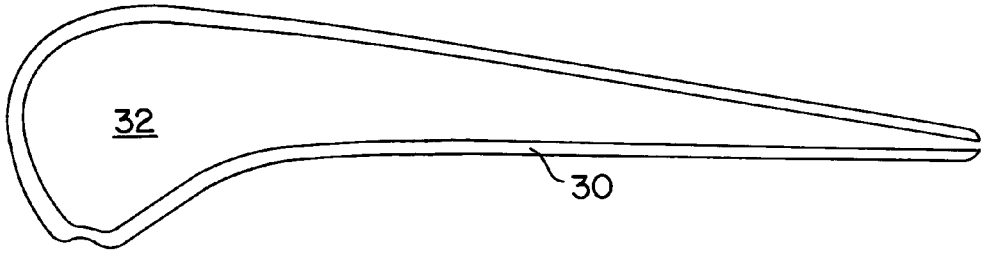
FIG. 4 is a schematic representation of a solid refractory metal forging for forming a turbine engine component.

Referring now to FIG. 4, in this embodiment, the casting system includes an outer wall 30 shaped in the form of an airfoil component and a refractory metal core 32 having a shape corresponding to the shape of the outer wall. The core 32, as before, may be made from the refractory materials listed hereinbefore. The core 32 in this embodiment is formed from a solid forging of refractory metal. If desired, the core 32 may have a ceramic coating on its exterior surfaces.

Figure 5:
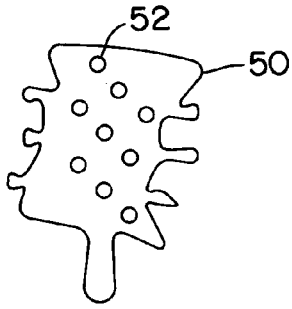
FIG. 5 illustrates a refractory metal core in the form of a balloon or pillow structure.

Referring now to FIG. 5, it is possible to replace thick ceramic cores in casting systems with thin wall refractory metal balloon or pillow structures 50. The structures 50 may be formed from any of the refractory metal materials described hereinbefore. The structures 50 may be formed by either deep drawing or expanding the walls under high pressure gas to conform to the internal cavity of a die. The shape may be supported by either pressurized gas or back filled with an inert material such as pressurized inert gas, sand, or ceramic powder. As long as sufficient surface of the structure 50 is accessible from the outside after the casting process is over (such as bottom of a blade), the compressed gas or filler material can be let out, leaving only thin skin to be leached. If desired, the structures 50 may be provided with a plurality of dimples and/or protrusions 52.

Figure 6:
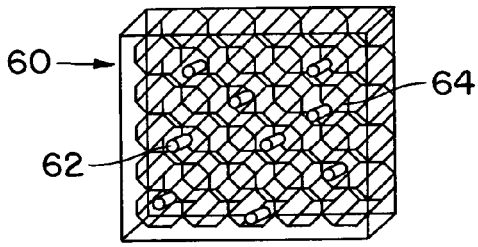
FIG. 6 illustrates a refractory metal core having a honeycomb shape.

It is also possible to create honeycomb shaped refractory metal core structures 60 by wrapping thin foils of refractory metal around a honeycomb or foam as shown in FIG. 6 and shaping it by pressing it between dies with internal cavities. This is equivalent to forming corrugated cardboard packing material using refractory metal sheets. Each structure may have a plurality of dimples 62 internally supported by ribs or honeycomb 64. Use of this approach is likely to save core leaching time. Once the volume of the core material is less than the core cavity, it is also possible to oxidize the core material, in spite of volumetric expansion of the oxide compared to the parent metal.

It is apparent that there has been provided in accordance with the present invention a refractory metal core which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A casting system for forming a gas turbine engine component, said system comprising a casting core formed by a shaped refractory metal sheet having a plurality of features for forming a plurality of film cooling passages, said features being formed from refractory metal material bent out of said sheet.

2. A casting system according to claim 1, wherein said refractory metal sheet has a leading edge and has a plurality of bent portions adjacent said leading edge.

3. A casting system according to claim 1, wherein said refractory metal sheet has a leading edge, a trailing edge, and a central portion between said leading edge and said trailing edge, and a plurality of bent portions in said central portion.

4. A casting system according to claim 1, wherein said refractory metal sheet is formed from molybdenum or a molybdenum alloy.

5. A casting system according to claim 1, wherein said refractory metal sheet is formed from a material selected from the group consisting of tantalum, niobium, tungsten, alloys thereof, and mixtures thereof.

6. A casting system for forming a gas turbine engine component comprising a metal wall having an airfoil shape and a refractory metal casting core adjacent said metal wall and having a shape corresponding to the shape of said metal wall.

7. A casting system according to claim 6, wherein said refractory metal core has a plurality of integrally formed cooling features formed by cut-outs.

8. A casting system according to claim 6, further comprising a metal structure internal of said refractory metal core.

9. A casting system according to claim 6, wherein said refractory metal core is formed from two pieces of sheet material and said pieces of sheet material being joined together at multiple locations.

10. A casting system according to claim 6, wherein said refractory metal core is formed from a solid forging of refractory metal.

11. A casting system according to claim 6, wherein said refractory metal core is formed from a material selected from the group consisting of molybdenum, tantalum, niobium, tungsten, alloys thereof, and mixtures thereof.

12. A refractory metal core for use in a casting system comprising a casting core having an outer surface formed from a refractory metal material, said outer surface defining an internal cavity filled with an inert material selected from the group consisting of pressurized inert gas, sand, and ceramic powder.

13. A refractory metal core according to claim 12, wherein said outer surface has a plurality of protrusions.

14. A refractory metal core according to claim 12, wherein said outer surface has a plurality of dimples.

15. A refractory metal core for use in a casting system comprising means for casting an object, said casting means comprising a honeycomb structure formed from a refractory sheet material, said honeycomb structure having a plurality of dimples internally supported by ribs.

16. A refractory metal core according to claim 15, wherein said honeycomb structure comprises a casting core.

17. A casting system according to claim 6, wherein said refractory metal casting core contacts an internal wall of said metal wall.

* * * * *